US006437504B1

(12) United States Patent
Foo

(10) Patent No.: US 6,437,504 B1
(45) Date of Patent: Aug. 20, 2002

(54) COLD-END DEVICE OF A LOW-PRESSURE MERCURY VAPOR DISCHARGE LAMP

(75) Inventor: Onn Fah Foo, Kowloon (HK)

(73) Assignee: Mass Technology (H.K.) Ltd., Kowloon (HK)

( * ) Notice: Subject to any disclaimer, the term of this patent is extended or adjusted under 35 U.S.C. 154(b) by 0 days.

(21) Appl. No.: 09/577,090

(22) Filed: May 24, 2000

(30) Foreign Application Priority Data

May 26, 1999 (CN) ..... 99211264 U

(51) Int. Cl.[7] ..... H01J 17/20

(52) U.S. Cl. ..... 313/573; 313/485; 313/634; 313/493

(58) Field of Search ..... 313/573, 565, 313/25, 26, 493, 483, 484, 485, 634, 639, 635

(56) References Cited

U.S. PATENT DOCUMENTS 4,835,442 A * 5/1989 Sugimoto et al. ..... 313/565

* cited by examiner

*Primary Examiner*—Vip Patel
*Assistant Examiner*—Joseph Williams
(74) *Attorney, Agent, or Firm*—Rabin & Berdo, P.C.

(57) ABSTRACT

This invention relates to a kind of illuminator particularly to a cold-end device of a low-pressure mercury vapor (LPMV) discharge lamp. The external glass tube of the invention is connected onto the lamp tube wall, which is opened up to the inner room of the lamp tube, and isolated from the outside. Since the cold-end device can be adjusted by the length of the external glass tube fore-mentioned and the sealing end position of the glass tube, the optimal cold-end temperature can be achieved and thus a larger light flux can be output from the energy conservation lamp in working.

6 Claims, 6 Drawing Sheets

COLD-END DEVICE OF A LOW-PRESSURE MERCURY VAPOR DISCHARGE LAMP

This invention relates to a kind of illuminator, or more specifically to a cold-end device of a low-pressure mercury vapor discharge lamp (DLLPMV).

BACKGROUND OF THE INVENTION

It is well known that illumination of a DLLPMV is within the discharging area. The electronic energy level of Hg atom is transited to radiate ultra-violet rays, and then the fluorescent powder in the tube is excited to radiate visible lamp. The stronger the ultra-violet lamp is, the larger the light flux is. The intensity of the ultraviolet lamp is dependent on the density of the Hg atoms, i.e. it is related to the pressure of the mercury vapor. For a lamp tube with certain structure and power, an optimal value exists between the mercury vapor pressure value and the light flux value of the lamp. Therefore, it is critical to control the pressure of the mercury vapor to be within the optimal pressure.

The pressure of the mercury vapor in the lamp tube corresponds to the coldest point (generally named as cold-end) of the lamp in operation. To achieve the optimal light flux, measures must therefore be taken to decrease the temperature of the cold-end. The EC lamps available in the market, especially those with cover and those with large surface power load, usually have very high cold-end temperatures. For instance, the cold-end temperature of the 20 W EC lamp with cover is about 123 degree. The methods generally adopted in the world to decrease the cold-end temperature are to lengthen the exhaust pipe of the lamp tube to form a cold-end. As in FIG. 1, an extra segment 14 of exhaust pipe is added to the exhaust hole 18 made by the technology available currently, where 10 is the mercury alloy placed at the cold-end. When this cold-end device is applied to the integrated EC lamp, with all the components assembled on it, the cold-end in FIG. 1 seems to be at the center of the electronic ballast. The actual effect of this coldend device, however, is poor, i.e. the cold-end temperature fails to decrease due to the influence of its small volume and heating of the electronic components themselves. Moreover, the setting of this cold-end device is not good to the design assembly and the further reduction of its volume.

SUMMARY OF THE INVENTION

To well solve the above problems existing in the cold-end devices of EC lamps, especially those with cover and large surface power load, this invention is invented to provide a kind of cold-end device of a DLLPMV. The optimal cold-end temperature can be achieved, and hence a larger light flux of the working EC lamp can be achieved by adjusting the length and the position of the glass tube which is connected onto the cold-end.

The purpose of this invention is realized in such an way: A cold-end device of a DLLPMV of this invention, includes the external glass tube and mercury alloy placed in the glass tube as mentioned. Its feature lies in that the external glass tube of this model is connected to the wall of the lamp tube and is opened up to the inner room of the tube and thus isolated from the outside. The sealing end of the external glass tube fore-mentioned is far away from the heat source setting. It is preferable to place the sealing end near the top setting of the glass tube. Furthermore, the length of the external glass tube ranges from 5 mm to around two times of the lamp tube height (2H). When the external tube is long, U-shape is adopted for it; and when it is short, the shape similar to a bulb is adopted. However, L-shape is usually taken for it.

Its advantages and benefits are quite significant as compared with the prior art. Simply because the cold-end device of the model can be adjusted in the length of the external glass tube and the position of the sealing end of the glass tube, to be far away from heat source, the optimal cold-end temperature can be achieved, and hence a larger light flux of the EC lamp in operation can be output.

BRIEF DESCRIPTION OF DRAWINGS

The specific embodiment of this invention will be explained below together with the attached figures.

DETAILED DESCRIPTION OF PREFERRED EMBODIMENT

Figure 1:
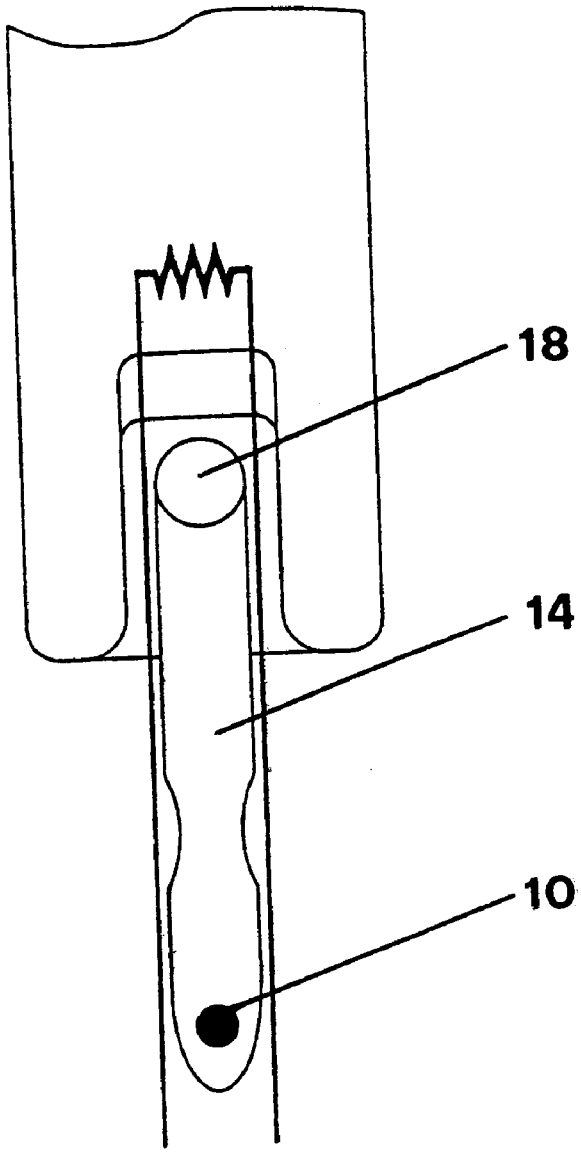
Figure 1 (prior art)
FIG. 1 is the partial diagram of the lamp tube with exhaust pipe in an EC lamp made by the prior art.
Figure 2:
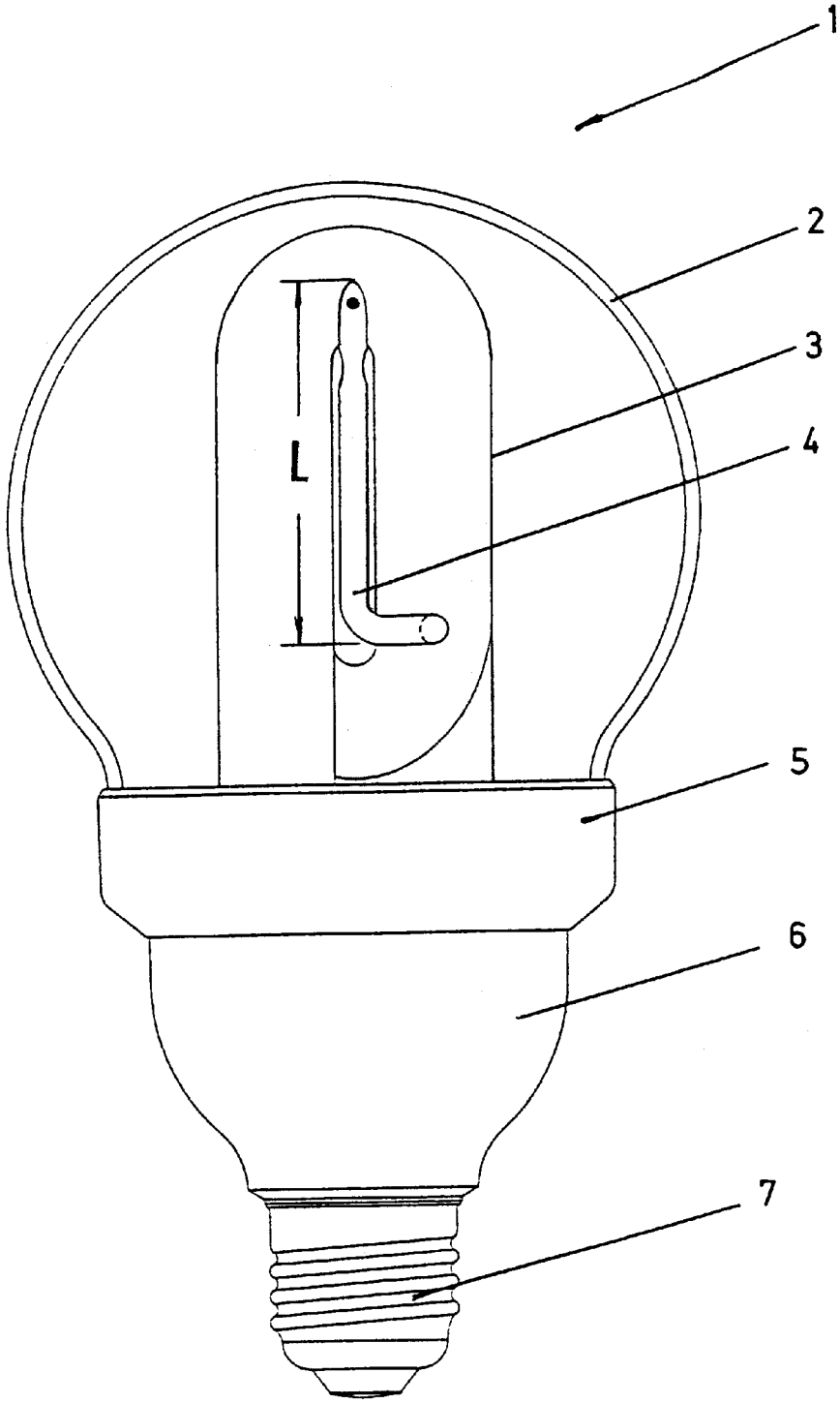
FIG. 2 is the diagram of an EC lamp with cover, equipped with the cold-end device of this invention.

As shown in FIG. 2, an EC lamp 1 with cover normally includes a lamp cover 2, a lamp tube 3, an external glass tube 4, a fixing base 5 of the lamp tube, the accessories 6 of the EC lamp and a contact part to the lamp holder 7. The accessories of the EC lamp as mentioned include electronic ballast, trigger, etc.

Figure 3:
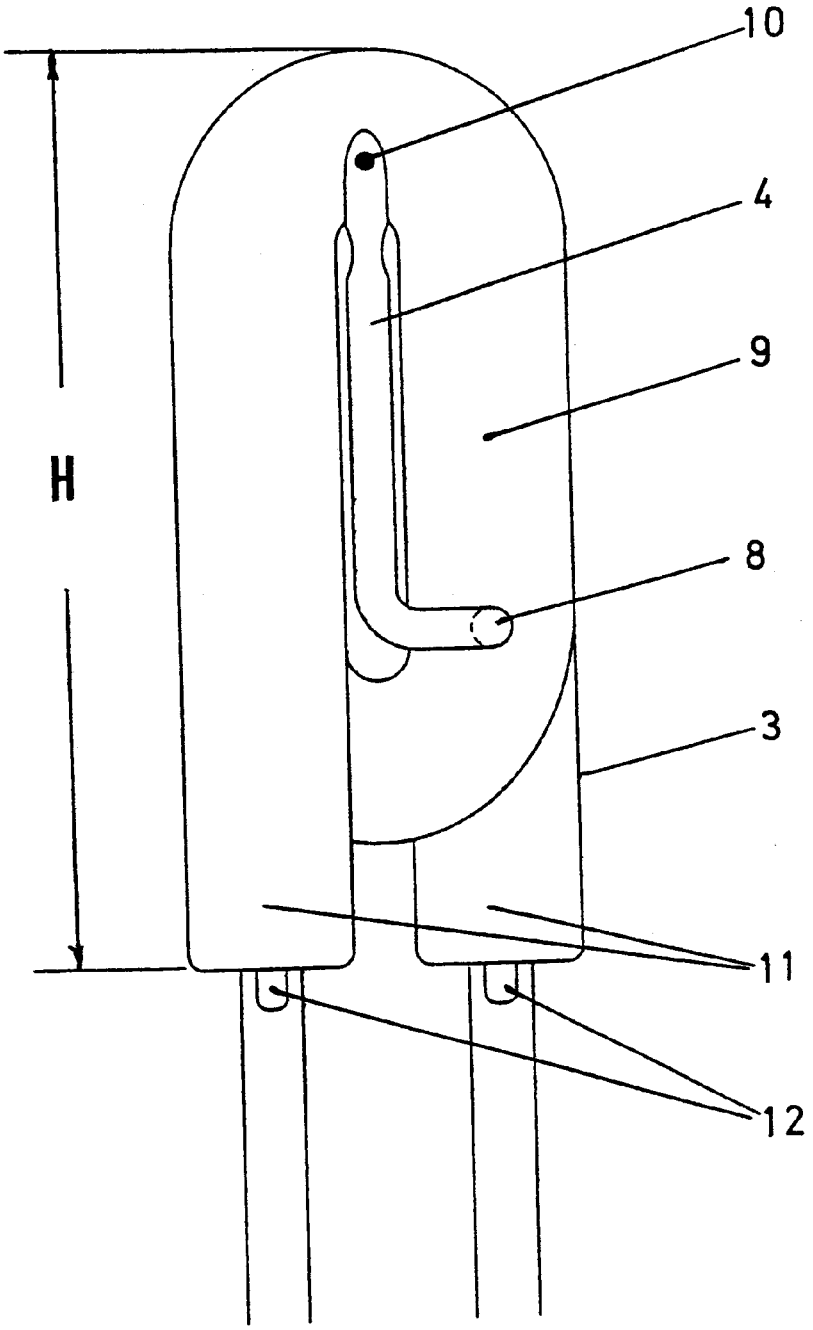
FIG. 3 is the diagram of the example of the lamp tube, equipped with the cold-end device of this invention.

As shown in FIG. 3, the lamp tube 3 includes an external glass tube 4, discharge area 9 in the lamp tube, cathode area 11 and an exhaust hole 12 of the lamp tube, where the external glass tube 4 is connected onto the tube wall hole 8, opened up to the inner room of the lamp tube and isolated from the outside.

As shown in FIG. 3, the height of the lamp tube 3 is referred to as H. Fluorescent powder is coated on the inner surface of the tube, with a group of the identical electrodes installed at each end. Each group of electrodes includes an electrode filament coated with electron emission powder. Properly excessive amount of mercury must be poured into the lamp tube, so as to ensure the continuous mercury consumption in long-term ignition. The excessive mercury is condensed to the cold-end during operation. When the mercury alloy is employed, it should be placed at the coldend to facilitate the mercury absorption by the mercury alloy. The mercury alloy placed at the cold-end of this model is located at the end 10 of the external glass tube 4.

As the heat energy of the lamp tube is generated by the discharging area 9 and the cathode area 11, and the influence of other heat sources are taken into account at the same time, the cold-end should be set as far as possible away from these heat sources, i.e. the cold-end should be put as close as possible to the top setting of the lamp tube, as shown in FIG. 2.

Figure 5:
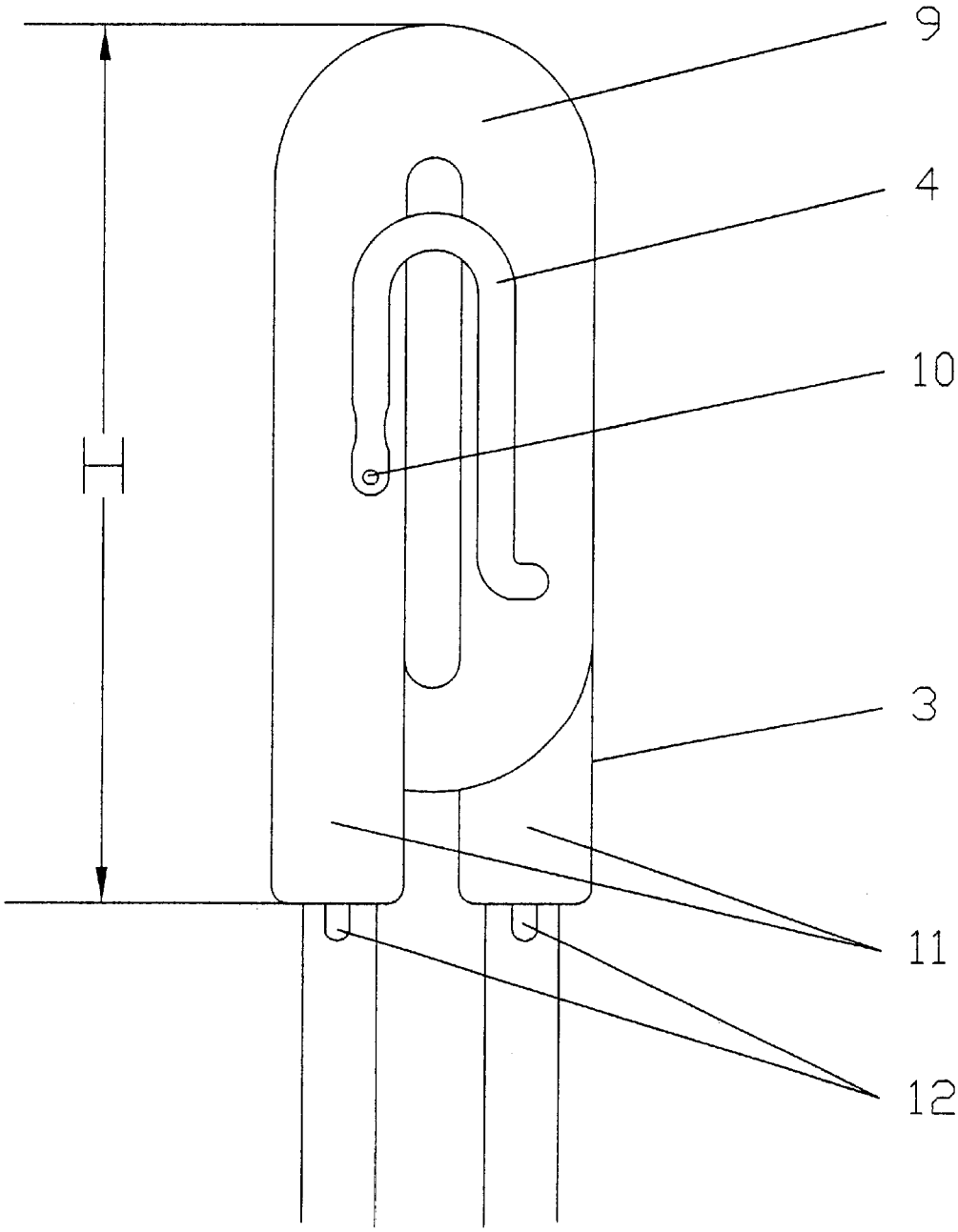
FIGS. 5 and 6 show the external glass tube being u-shaped and bulb-shaped, respectively.
Figure 6:
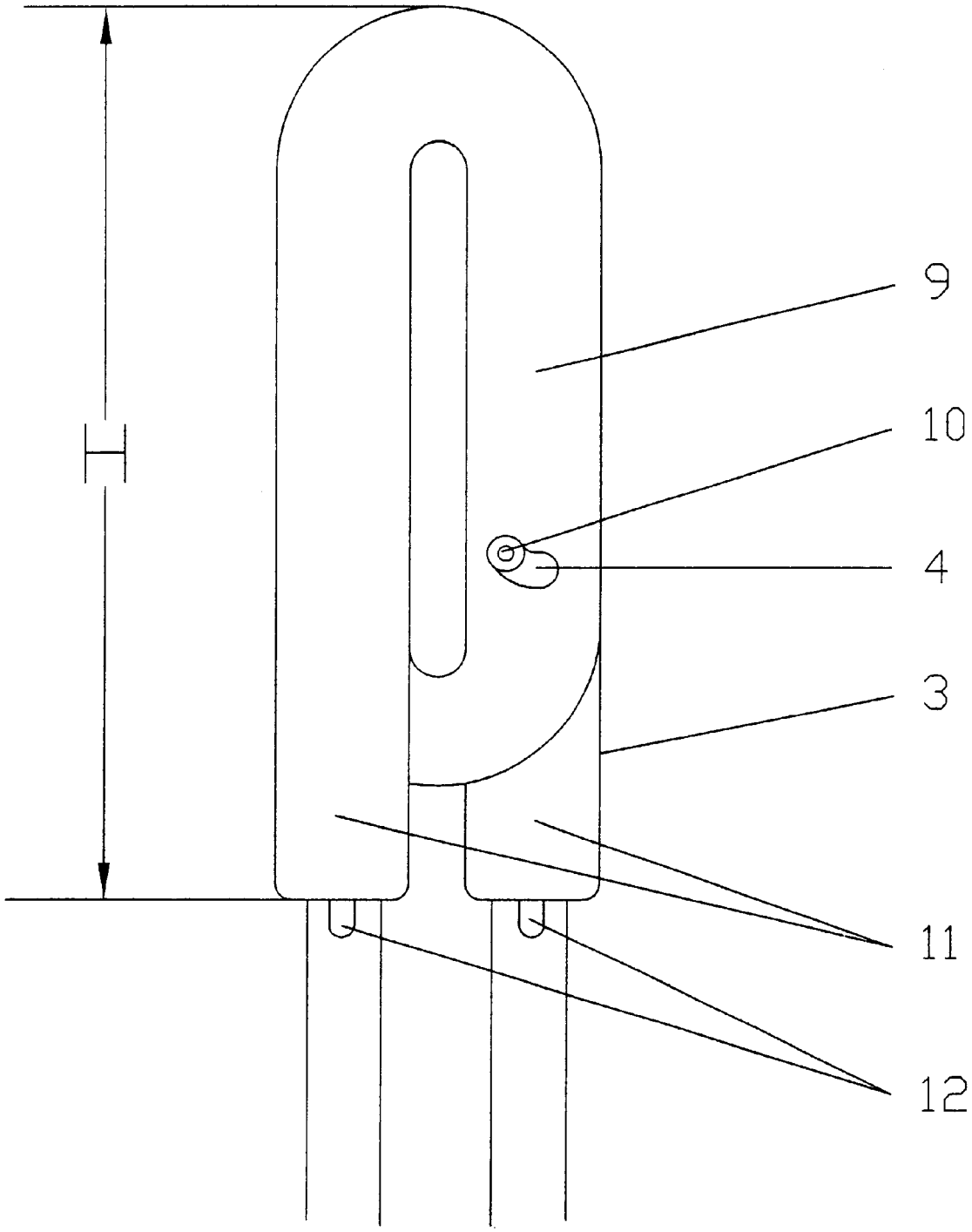

The length of the external glass tube 4 is from 5 mm to two times of the lamp tube height (i.e., 2H). When the length is shorter than 5 mm for the glass tube, the effect of the cold-end is little due to its shortness, and the temperature can be decreased by only several degrees. However, the length of the glass tube can not be longer than 2H due to the restriction of space position. The external glass tube 4 can be bulb-shaped to be suitable to the short external glass tube (as shown in FIG. 6), or can be U-shaped for a long one (as shown in FIG. 5), or L-shaped for a medium sized one.

The external glass tube 4 is connected with lamp tube 3 in the following way. First a connection point is selected on the tube wall. Then a small hole is blown by liquid fire gun after the glass is melted. And then the external glass tube is connected on to it immediately. The heating process is taken to melt and seal the two, ensuring that the glass tube is open to the inside of the lamp tube. When mercury alloy is placed into the glass tube from the other end, it is sealed to isolate the external glass tube from the outside.

Figure 4:
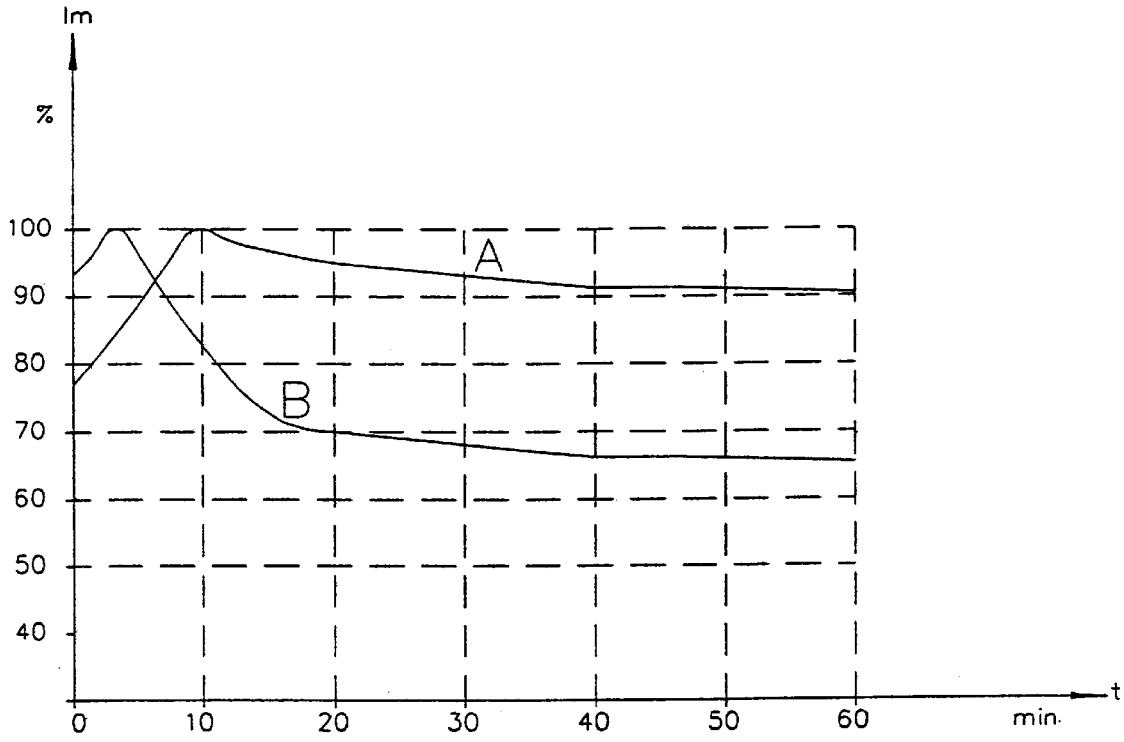
FIG. 4 shows the comparison curves of light fluxes between the EC lamps equipped with and without the cold-end device of this model.

Two identical 20 W EC lamps with covers are adopted for contrast, with one using the cold-end device of this utility model whose glass tube length L is 5 cm as shown in FIG. 2. And the other is without the cold-end device. Experiments are simultaneously taken on both lamps under the same conditions. The experimental results are as follows:

1. The light flux of the EC lamp. The experimental results are plotted as the curves shown in FIG. 4, where the vertical coordinate represents the light flux and the horizontal coordinate is used for the time. A represents the light flux that about 90% of the maximum light flux output can be obtained by using this cold-end model, while the light flux lower than 70% can be achieved by EC lamp B.

2. The cold-end temperature of the EC lamp. It is measured that the cold-end temperature of the EC lamp is 92 degree for this model, while the cold-end temperature is 123 degree for the comparison lamp.

It can be concluded from the above experiment results that the cold-end temperature can be significantly decreased by using this cold-end device, therefore generating a larger light flux output when the EC lamp is working.

Although only the optimal implementation case with this invention is explained in details, it should be pointed that various kinds of variant and modified types can be made under the idea of this invention. These variant and modified types should be protected under this invention.

What is claimed is:

1. A low-pressure mercury vapor discharge lamp, comprising:

a lamp tube adapted for producing visible light and having two ends, each end being connected to a respective electrode, said lamp tube being shaped to have an upper U-shaped bend and a lower U-shaped bend, the upper U-shaped bend being disposed distal to the two ends, and the lower U-shaped bend being disposed proximate to the two ends;

an external glass tube having an open end connected to a wall of said lamp tube in a region distal to the upper U-shaped bend with an interior of said external glass tube being in open communication with an interior of said lamp tube, said external glass tube having a sealed end disposed more proximate to the upper U-shaped bend than the open end is, said external glass tube projecting no further than the upper U-shaped bend; and a mercury alloy placed in the external glass tube.

2. The low-pressure mercury vapor discharge lamp as described in claim 1, wherein a length of the external glass tube is from 5 mm to about two times of a height of the lamp tube.

3. The low-pressure mercury vapor discharge lamp as described in claim 1, wherein the external glass tube is L-shaped.

4. The low-pressure mercury vapor discharge lamp as described in claim 1, wherein the external glass tube is U-shaped.

5. The low-pressure mercury vapor discharge lamp as described in claim 1, wherein the external glass tube is bulb-shaped.

6. The low-pressure mercury vapor discharge lamp as described in claim 1, further comprising fluorescent powder coating an inner surface of the wall of said lamp tube.

* * * * *